United States Patent [19]

Greenberger

[11] 4,216,348

[45] Aug. 5, 1980

[54] ROOF ASSEMBLY FOR AN ELECTRIC ARC FURNANCE

[75] Inventor: Joseph I. Greenberger, Pittsburgh, Pa.

[73] Assignee: Wean United, Inc., Pittsburgh, Pa.

[21] Appl. No.: 11,289

[22] Filed: Feb. 9, 1979

[51] Int. Cl.[2] ..... F27D 1/12; F27D 1/18

[52] U.S. Cl. ..... 13/32

[58] Field of Search ..... 13/32, 35, 16; 266/241; 432/238, 237; 110/331, 335

[56] References Cited

U.S. PATENT DOCUMENTS

| | | | |
|---|---|---|---|
| 3,385,241 | 5/1968 | Alvis et al. . | |
| 3,788,015 | 1/1974 | Musser . | |
| 4,021,603 | 5/1977 | Nanyo et al. | 13/35 |
| 4,063,028 | 12/1977 | Longenecker . | |
| 4,091,228 | 5/1978 | Brown, Jr. et al. . | |
| 4,107,449 | 8/1978 | Sosonkin et al. . | |
| 4,110,548 | 8/1978 | Dresch et al. | 13/16 |
| 4,122,295 | 10/1978 | Nanjo et al. . | |

*Primary Examiner*—Roy N. Envall, Jr.

*Attorney, Agent, or Firm*—Daniel Patch; Suzanne Kikel

[57] ABSTRACT

A roof assembly for an electric arc furnace formed by a series of water cooled panels supportingly arranged between the water conveying outer ring and a water conveying center ring encircling the electrode-refractory area. One or more of these panels are constructed of a copper face sheet brazed to a steel backing sheet having groups of several machined traverse passageways, and are located in critical areas in the roof. Communicating with each group of passageways is a water entry header and a water discharge header. The outer ring acts as both a water source and drainage for the panels and center ring. The panels are suspended from a self-supporting spider web structure which carries the center ring and is supported by the outer ring.

12 Claims, 7 Drawing Figures

ROOF ASSEMBLY FOR AN ELECTRIC ARC FURNACE

The present invention relates to a roof assembly for an electric arc furnace used in manufacturing ferrous and non-ferrous metals and to fluid cooled panels employed in the roof and walls of such a furnace or the like.

Present electric arc furnace roof and wall construction utilizing refractories have limited life spans due largely in part to the high heat loads created by the electrodes. Typically, large ultra-high power electric arc furnaces ranging from 50,000 to 200,000 BTU/Ft.$^2$ Hr. require frequent and expensive refractory replacement of both the roof and walls.

As disclosed in the prior art, several recent attempts have been made to extend the service life of the roof and walls of an electric arc furnace. The prior art discloses employing an outer ring and/or an inner ring carrying a coolant for cooling the roof, and a number of cooling panels and several different ways of supporting the panels when assembled in the roof. Each of these panels, however, have certain serious disadvantages: namely, in the manner of supporting the roof panels with the required factor of safety and convenience of removability; the manner of transferring coolant to and from the rings and panels with the necessary cooling efficiency and dependability; and the manner of constructing a panel per se with the required economical, dependable and technical effectiveness.

The above disadvantages and limitations of present and past roof assemblies and roof and wall panel constructions are overcome by the present invention.

More particularly an object of the present invention is to provide a roof assembly having means for supporting the roof panels with an optimum degree of safety and having a cooling system including a panel construction for providing an optimum cooling of the roof area thereby resulting in less frequent roof replacement whereby down time and maintenance costs are minimized.

Another object of the present invention is to provide a roof assembly for an electric arc furnace having a centrally located roof closure means with electrodes associated therewith, and comprising: a first ring means having passageways for receiving cooling medium and defining the outer periphery of said roof assembly; a second ring means located concentrically and inwardly of said first ring means and defining the outer periphery of said roof closure means and including passageways for receiving cooling medium to cool said roof closure means; means for permitting said second ring means and said roof closure means to be removed and replaced as a unit to and from said roof assembly; a plurality of panel units constructed and arranged between said first and second ring means and having a series of passageways; supporting means having a portion for carrying said first ring means and a portion for supporting said second ring means, and coolant medium transfer means for bringing and taking away coolant medium to and from said passageways of said first and second ring means and said panel units for cooling said panel units and said closure means.

A still further object of the present invention is to provide a panel made of two different metals to be used in at least the critical areas of both the roof and side wall of an electric arc furnace. More particularly, the present invention provides a panel unit for the roof or walls of an electric arc furnace comprising two members made of different metals forming an outside and inside of said panel and having different heat transfer properties in which the inside member has a sufficiently higher heat transfer property and is arranged to face the interior of said furnace; said outside member is constructed and arranged relative to said inside member in a manner to form passageways therebetween for receiving cooling medium to cool said inner member.

These objects as well as other features and advantages of the present invention will become better understood when the following description of a preferred embodiment thereof is read along with the accompanying drawings of which:

Figure 1:
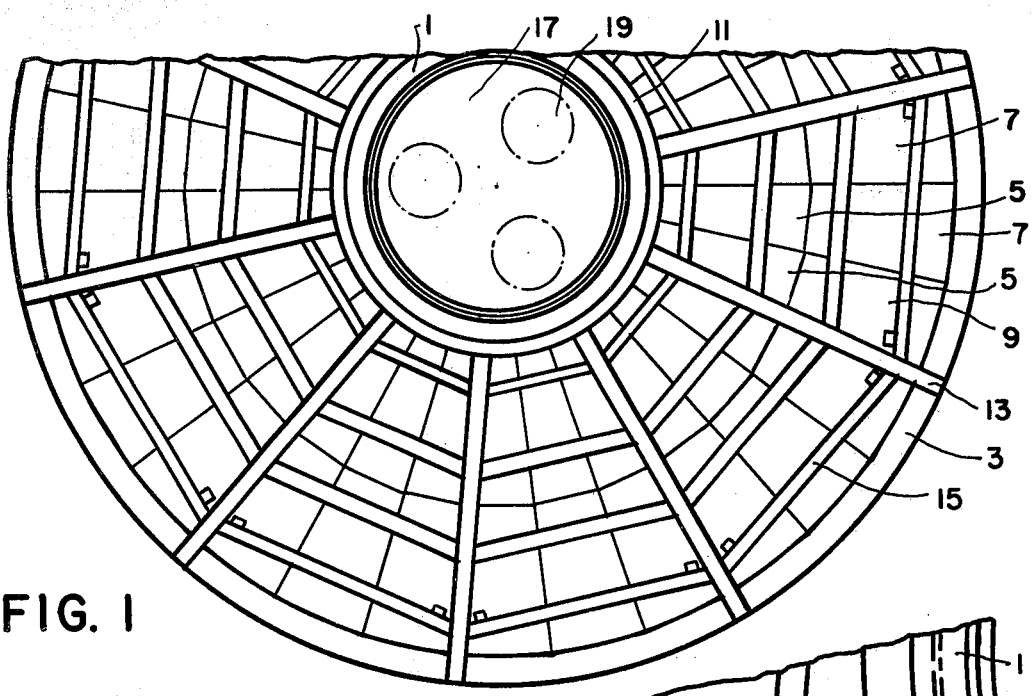
FIG. 1 is a partial plan view of the present invention.

The type of electric arc furnace in which the present invention is well known in the art, and therefore as to the construction of the furnace, only the roof assembly will be described with the specificity required to understand the portion of the invention pertaining thereto. In the drawings the same numbers designate similar components.

Figure 2:
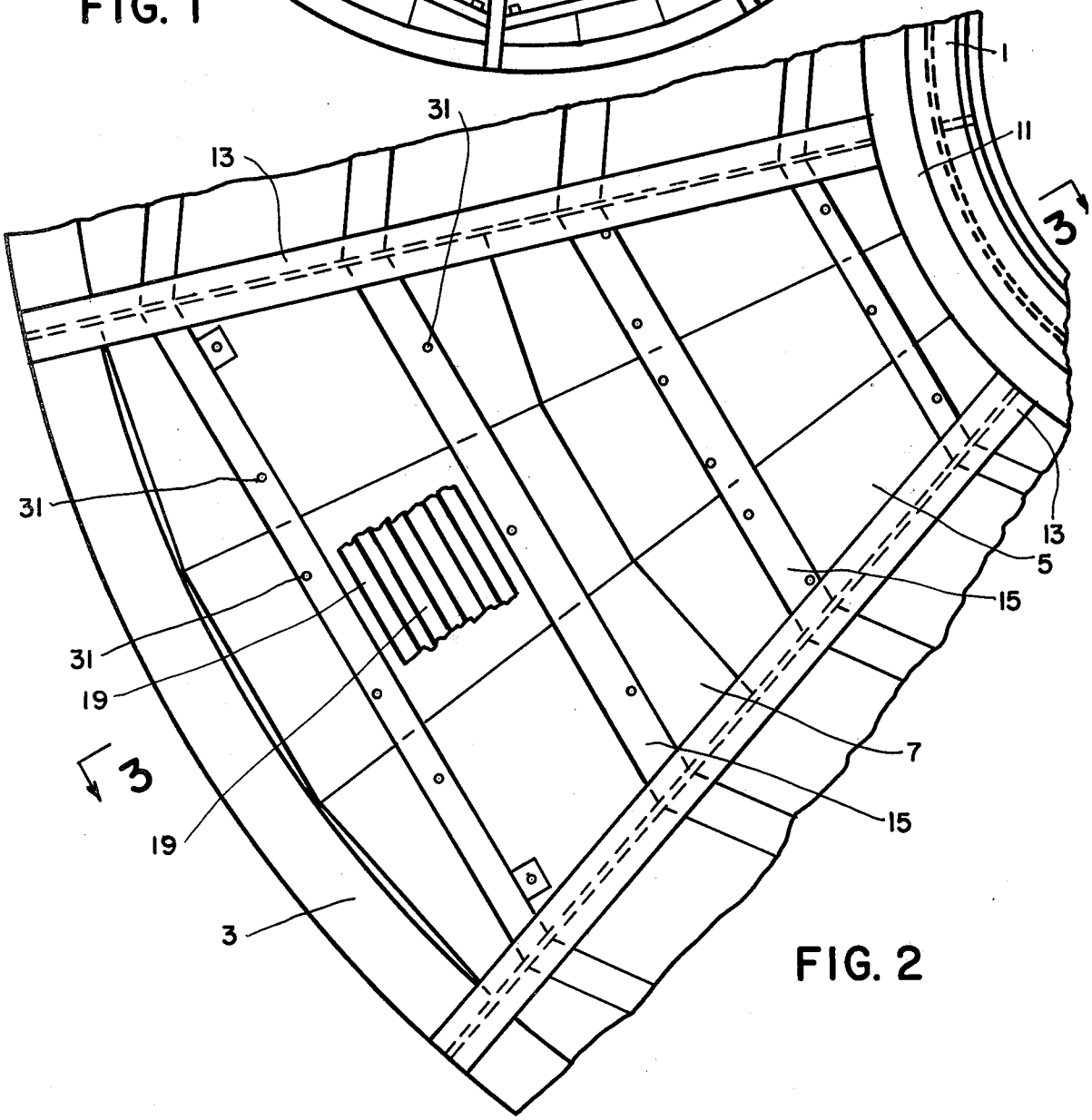
FIG. 2 is an enlarged view of a section of FIG. 1.
Figure 3:
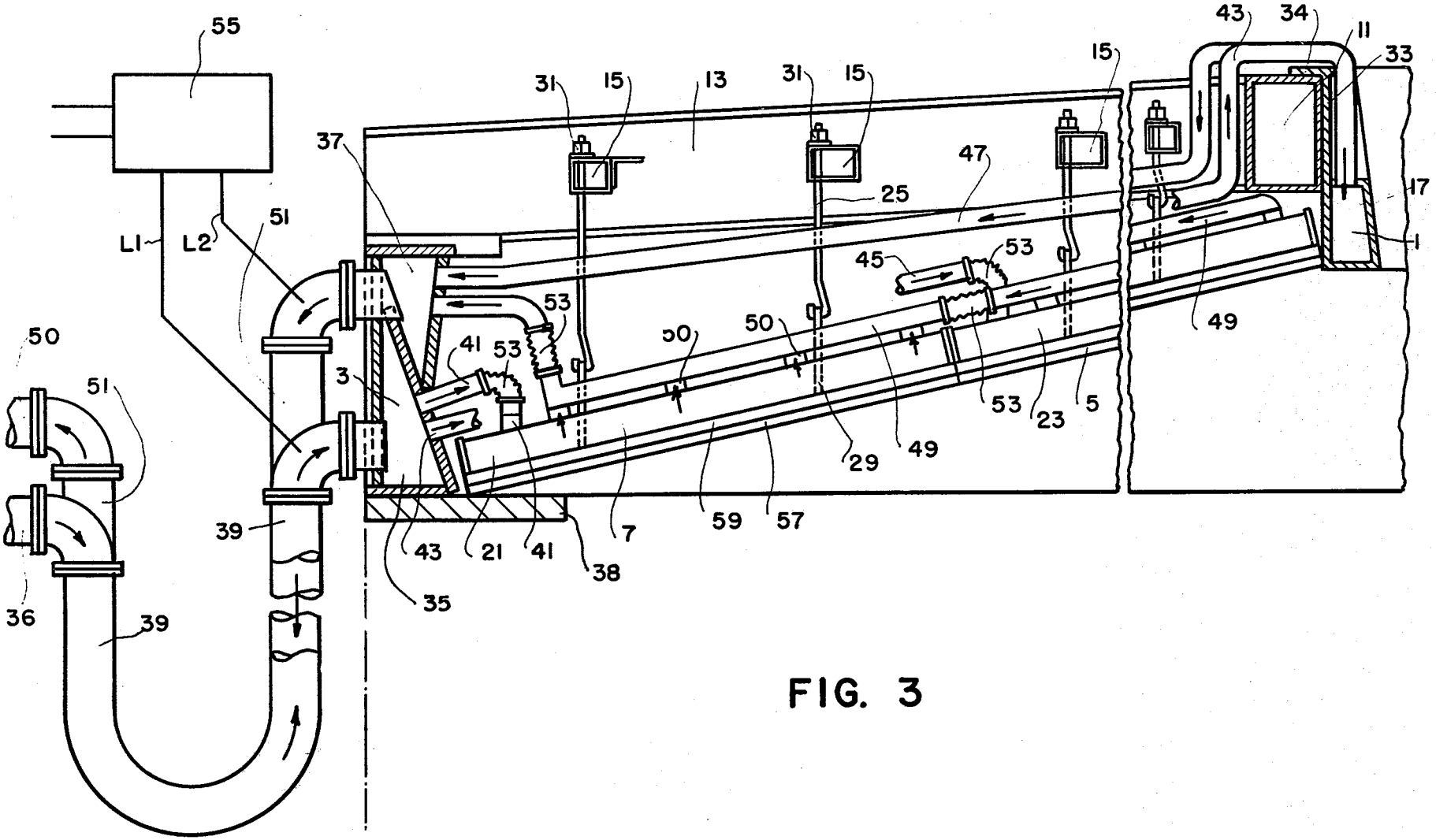
FIG. 3 is a sectional view taken along lines 3—3 of FIG. 2.

Referring to FIGS. 1, 2 and 3, there are radially arranged between a hollow watertight inner roof ring 1, and a hollow watertight outer roof ring 3 of a large diameter furnace, two concentric rows of inner and outer water cooled panels 5 and 7, respectively, formed into a truncated cone and which may be self-supporting due to the geodesic abutting relationship of each panel with an adjacent panel.

Figure 4:
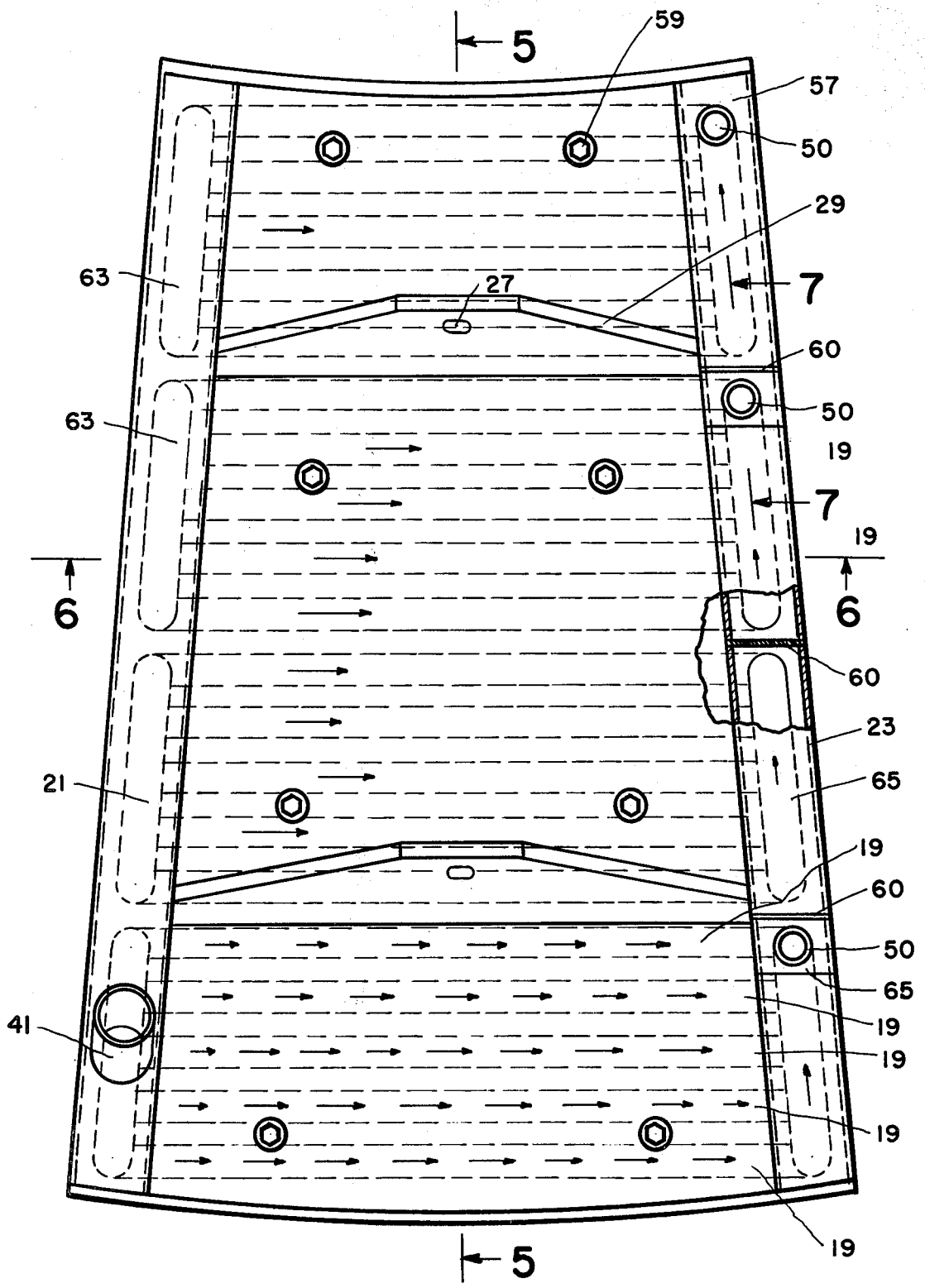
FIG. 4 is a detailed plan view of a panel of the present invention.

In FIG. 4 the panels are shown with a radius at their base and top which form is an alternate in employing a geodesic form. These panels 5,7 are basically supported by being suspended from a self-supporting structural spider web arrangement 9, best shown in FIGS. 1 and 3, consisting of: a circular rigid member 11 arranged concentrically and outwardly from a coolant carrying inner ring 1; a number of spaced-apart radial ribs 13 fixedly secured to circular member 11 at one end outer ring 3 at the other end; and a number of cross members 15 fastened to radial ribs 13 at each end.

Arranged concentrically inwardly of and connected to inner ring 1 is an inner ring zone or closure 17 comprised of refractory material. Portions of this inner ring can be of a panel or equivalent construction which can also be water cooled. Formed in the roof closure 17 are three openings 19 for permitting the entry of the electrodes into the furnace during the melting operation. A vent, not shown, is also provided in the closure 17 for the escapement of smoke and other waste gases in the usual manner.

As shown in FIGS. 2, 4 through 7, inner and outer panels 5 and 7 have several groups of distinct parallel traverse passageways 19. These passageways 19 communicate with fluid entry header 21 and fluid discharge header 23, particularly shown in FIG. 6, for carrying a cooling medium, such as water, through the panel. Headers 21, 23 are formed from a steel plate or several steel plates welded together, more about which will be said later. For stability and similar balance conditions, each roof panel 5,7 is suspended from cross member 15 at three points as indicated by nuts 31 shown best in FIG. 2, by adjustable suspension rods 25 of varying lengths passing through opening 27 of bracket 29 of each panel 5, 7 as particularly shown in FIG. 3. The adjustments of suspension rods 25 are done through nuts 31 fastened to a threaded end of the rods extending through cross member 15. After the panels are assembled and the suspension rods properly adjusted, suitable refractory or other insulating material can be used to fill voids or gaps between or around adjacent panels.

Both the inner ring 1 and the outer ring 3 are assembled from steel plates by welding. As particularly seen in FIG. 3, inner ring 1 is substantially rectangular and has an extension 33 extending parallel to an adjacent side of member 11 and having a horizontal surface 34 carried by the upper surface of circular member 11. This allows upon simply disconnecting the relevant piping, the closure 17 to be removed and replaced with inner ring 1 as explained later. Outer ring 3 consists of two water sealed compartments 35 and 37 acting as a water inlet and discharge respectively, and is supported by side wall 38 of the furnace as are outer panels 7.

As indicated by the arrows pointing in the direction toward the right of FIG. 3, main supply line 36 feeds water into compartment 35 of ring 3 at a sufficient pressure to cause water to flow through pipe lines 41 and 43 and into outer panel 7 and inner ring 1, respectively. The water delivered to inner ring 1 is controlled to flow around the inner ring in one direction until it is removed. Similarly, a third pipe line 45 connected to compartment 35 carries the water to the inner panel 5. The arrows pointing to the left indicate the manner in which the water is carried away from the roof assembly. Pipe line 47 carries water away from inner ring 1, and pipe line 49 communicating with pipes 50, carries water away from inner and outer panels 5, 7 into the discharge compartment 37 from which it is taken away from the furnace by main drainage line 50. Flexible connections 53 connect pipe lines 41, 43, 45, 47 and 49, to carry water to and from the panels and inner ring 1, to the outer ring 3, and flexible pendant type water entry and discharge connections 39, 51 connected to stationary lines 36, 50, respectively, permit movement of the roof without disconnecting the water system. While only pendant connections 39,51 connected to lines 36,50 respectively, are shown, depending on the circumstances, two or more such systems could be used in a roof assembly. Even though it is not shown in the figures, the piping system connecting the outer ring 3 to the panels 5,7 in FIG. 3 is normally provided for each two concentric row panel arrangement, i.e., for each group of inner and outer panels 5,7. If water heating conditions permit, several panels may be connected in series for water cooling.

The water inflow and water discharge temperatures are monitored by electrical control 55 to detect through the agency of lines $L_1$ and $L_2$, the temperature differential and to automatically adjust the volume of water inflow to provide optimum cooling to the panels 5,7 and inner ring 1 which cools the roof closure 17.

The roof closure 17 being suspectible to high heat loads, tends to fail before the marginal or outer roof sections. Since closure 17 and inner ring 1 are constructed independently from the other components of the roof assembly, they can be quickly removed and replaced as a unit without disturbing the panels. This substantially reduces down time and maintenance costs. Since the inner ring 1 provides a more efficient cooling to the closure zone 17 than ever before realized, replacement of the center zone 17 is also minimized.

Figure 5:
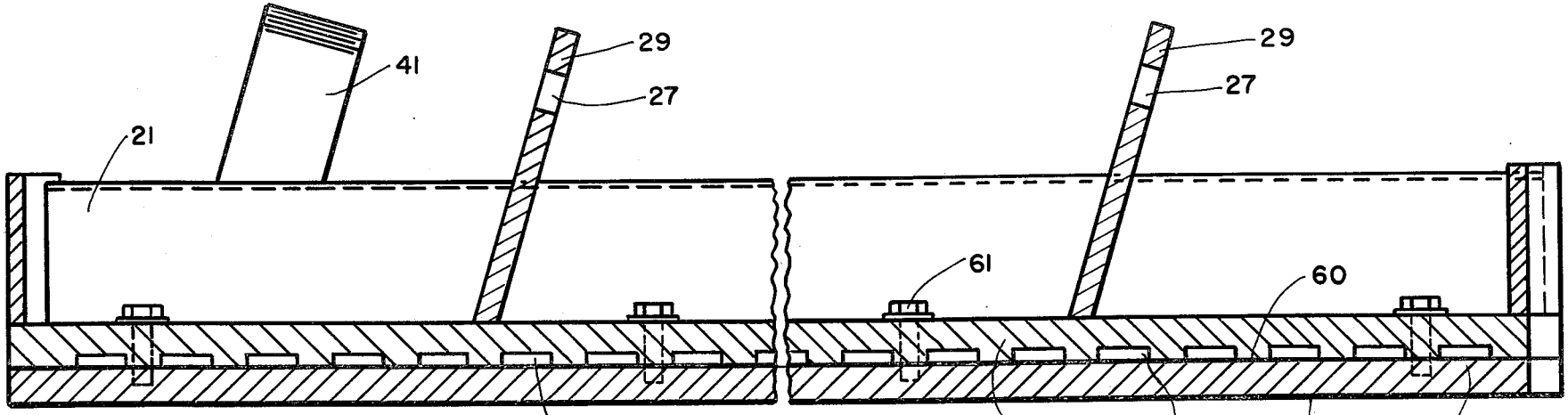
FIG. 5 is a sectional view taken along lines 5—5 of FIG. 4.
Figure 6:
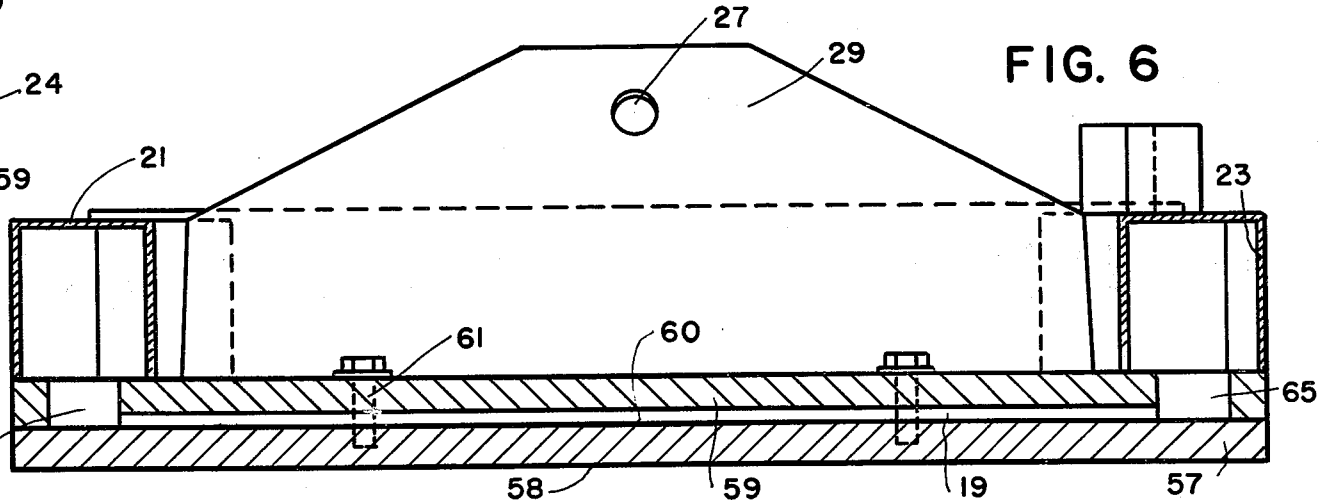
FIG. 6 is a sectional view taken along lines 6—6 of FIG. 4.
Figure 7:
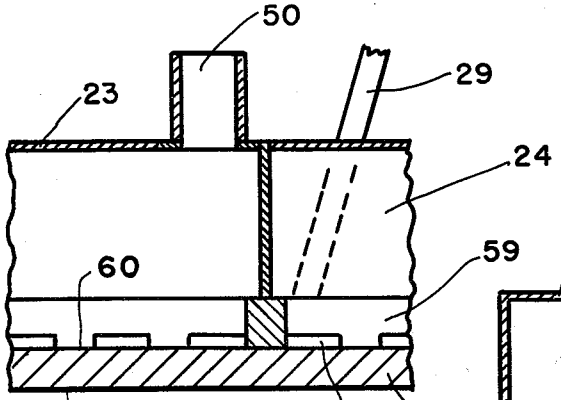
FIG. 7 is a sectional view taken along lines 7—7 of FIG. 4.

Referring again to FIGS. 4–7, a sandwich type panel is shown. The panel shown consists of a highly conductive copper or copper alloy face 57 having a surface 58 which, when the panels are assembled at least in the critical areas of a roof or wall assembly of a furnace points toward the inside of the furnace. This copper face 57 is brazed and/or mechanically connected to a steel back up plate 59 by bolts 61. As can be seen in FIGS. 5 and 7, passageways 19 machined in the hot side of steel plate 59 are contiguous to a continuous surface 60 of copper plate 57 opposite its hot side 58. Two different metals can be used in place of copper and steel, the metal having the higher conductivity replacing the copper plate, and the lower conductivity replacing the steel plate. As clearly shown in FIG. 4, four pairs of transversely opposed machined longitudinal recesses 63 and 65 each service a group of five transverse watertight passageways 19 in steel plate 59 and, as mentioned previously, communicate with entry header 21 and discharge header 23. These headers 21, 23 are brazed onto steel plate 59, and may extend the entire length of the panel.

In header 21, the opening extends the entire length of the header and panel; however, in header 23 there are three baffle plates 60, each equally spaced along the header's longitudinal axis to form four water discharge zones 65, each having a discharge pipe 50 communicating with pipe line 49. Water enters the opening of header 21 and as shown by the arrows in FIG. 4, travels through all passageways 19 into the four discharge zones 65 and up through pipe 50 associated with each zone 65. This arrangement of header 23 prevents water already discharged from passageways 19 from flowing into the other zones servicing their respective group of passageways, and provides means to remove water from the panel.

For high heat flux applications, the copper face 57 can be relatively thin, and the passageways 19 as wide and shallow and closely arranged as possible as shown in FIG. 5 in cross section in order to allow a substantially high water volume to flow through the panel to limit the water temperature rise within reasonable limits. Typically, as much as 10 GPM/Ft.$^2$ of water may be needed for the higher heat flux applications. The wideness and shallowness of the traverse passageways 19 extending into the corners of the panel, together with the close arrangement of each group of passageways 19 result in an overall and effective cooling of the panel. Some advantages of this construction over a serpentine or hairpin piping configuration of the prior art are (1) the configuration of the water cooled passageways considerably reduces the temperature differentials of the hot face of the duplex panel; (2) a relatively low pressure for the same high water volume; (3) in the event clogging of some passageways occurs, the panel is not adversely affected due to the high heat loads, since the remaining open passageways provide efficient cooling thereof; and (4) cooling of the corners of the panel.

In operation in a furnace incorporating the cooling system of the present invention, water is directed from supply line 39 to compartment 35 to pipe lines 41, 43 and 45, to both the outer and inner panels 5, 7 and the inner ring 1 wherein the panels and ring 1 are fed separately from whence it then travels through pipe lines 47 and 49 into compartment 37 and through drain line 50 away from the furnace structure. During this process, control 55 monitors the temperature of the inflow and discharge, and adjusts the volume of inflow to change the cooling effect of the inflowing water to optimize the use of cooling water to the roof assembly.

The panel described herein is used in the roof of an electric furnace; however, as mentioned previously, this panel construction can also be used in the side wall above the slag line where heated loads resulting in failure of the panel is also a problem existing in electric arc furnaces, and in application of other furnaces. As previously noted, each roof or wall panel does not necessarily have to be of the described copper-steel sandwich panel. These panels will normally be used in the extreme hot spot areas of the furnace, and other panel construction such as cast iron panels may be used in the remaining roof or wall assembly. In order to reduce heat loss through the roof, or sidewalls, both the described duplex and cast iron panels will have a layer of insulation on the hot side of the panels. It is also noted that even though an outer and inner panel is shown herein for a roof assembly, that for a larger or smaller diameter roof, more or less than two rows of panels can be used.

In accordance with the provisions of the patent statutes, I have explained the principle and operation of my invention and have illustrated and described what I consider to represent the best embodiment thereof.

I claim:

1. A roof assembly for an electric arc furnace having a centrally located roof closure means with electrodes associated therewith, and comprising:

a first ring means having passageway means for receiving cooling medium and defining the outer periphery of said roof assembly;

a second ring means located concentrically and inwardly of said first ring means and defining the outer periphery of said roof closure means and including passageway means for receiving cooling medium to cool said roof closure means;

said second ring means and said roof closure means constructed and arranged to be removed and replaced as a unit to and from said roof assembly, a plurality of panel units constructed and arranged between said first and second ring means in a manner to be self-supporting and having a series of passageways, supporting means having a portion for carrying said first ring means and a portion for supporting said second ring means in a manner to permit said removal and replacement of said second ring means and closure means, and including means for additionally supporting said panel units, coolant medium transfer means for bringing and taking away a coolant medium to and from said passageway means of said first ring means, including means associated with said passageway means of said first ring means for carrying said coolant medium simultaneously to said passageway means of said second ring means and said passageways of said panel units and simultaneously away from said passageway means of said second ring means and said passageways of said panel units.

2. A roof assembly according to claim 1, wherein each panel unit comprises:

at least two members made of different metals forming an outside and inside of said panel and having different heat transfer properties in which said inside member has a sufficiently higher heat transfer property and is arranged to face the interior of said furnace, and said outside member is constructed and arranged relative to said inside member in a manner to form passageways therebetween for receiving cooling medium to cool said panel units.

3. A roof assembly according to claim 1, wherein said support means takes the form of a spider web-like configuration arranged above said roof assembly comprising:

with respect to the center of said rings, radially spaced structural members rigidly connected to said first and second ring means, with respect to said center of said rings, concentrically spaced structural members rigidly connected at their ends to said radial members, and carrying means mounted to and laterally spaced along said concentric members extending downwardly toward said furnace roof assembly and secured to said roof panel units.

4. A roof assembly for an electric arc furnace having a centrally located roof closure means with electrodes associated therewith and comprising:

a first ring means having passageway means for receiving cooling medium and defining the outer periphery of said roof assembly;

a second ring means located concentrically and inwardly of said first ring means and defining the outer periphery of said roof closure means and including passageway means for receiving cooling medium to cool said roof closure means, a plurality of panel units constructed and arranged between said first and second ring means, in a manner to be self-supporting and having a series of passageways, said panel units each consisting of at least a first and second member each having different heat transfer properties and in which said first member has a sufficiently higher heat transfer property and is arranged to face the interior of said furnace, and coolant medium transfer means for bringing and taking away a coolant medium to and from said passageway means of said first ring means including means associated with said passageway means of said first ring means for carrying said coolant medium simultaneously to said passageway means of said second ring means and said passageways of said panel units and simultaneously away from said passageway means of said second ring means and said passageways of said panel units.

5. A roof assembly according to claim 1 or 4, further comprising, means for monitoring the temperature of cooling medium at one or more places incident to its travel and for adjusting its heat transfer rate in a manner to obtain a desired cooling effect by the cooling medium.

6. A roof assembly according to claim 4 wherein said first and second members are made of different metals.

7. A roof assembly according to claim 4, wherein said member having the higher heat transfer property is copper or copper alloy and the other member is made of ferrous or non-ferrous metal other than copper or copper alloy.

8. A panel unit for the roof or walls of an electric arc furnace comprising:

two members made of different metals forming an outside and inside of said panel and having different heat transfer properties in which the inside member has a sufficiently higher heat transfer property and is arranged to face the interior of said furnace;

said outside member is constructed and arranged relative to said inside member in a manner to form passageways therebetween for receiving cooling medium to cool said inner member.

9. A panel unit according to claim 8 wherein said passageways are rectangular in cross section longitudinally of said panel unit formed on the hot side of said outside member, said passageways are constructed so that their depths are relatively narrow and their widths relatively wide compared with each other, and said passageways are closely arranged relative to each other, and wherein said inside member is constructed with a continuous plane surface on the side opposite its hot side which surface is arranged to be subjected to the direct application of coolant medium in said passageways.

10. A panel unit according to claim 8 wherein said member having the higher heat transfer property is copper or copper alloy and the other member is made of ferrous or non-ferrous metal other than copper or copper alloy.

11. A panel unit according to claim 8 wherein said passageways are arranged transversely to the longitudinal axis of the panel unit, and further comprises:

longitudinal recesses communicating with different groups of said transverse passageways, a first and a second header connected on opposite ends of said outside member and arranged relative thereto so as to communicate with said longitudinal recesses to bring and take away coolant medium to and from said transverse passageways of said panel.

12. A panel unit according to claim 11 wherein said first header substantially extends the entire length of said panel unit and is constructed to feed each said transverse passageway with incoming coolant medium and further comprising:

baffle means in said second header constructed and arranged to form distinct discharge zones at the discharge end of said passageways thereby preventing discharged coolant medium from passing from one zone to another.

* * * * *